United States Patent [19]

Gersch et al.

[11] Patent Number: 4,556,528

[45] Date of Patent: Dec. 3, 1985

[54] MOLD AND METHOD FOR CASTING OF FRAGILE AND COMPLEX SHAPES

[75] Inventors: Herbert M. Gersch, Torrance; Glenn W. Brown, Rancho Palos Verdes, both of Calif.

[73] Assignee: The Garrett Corporation, Los Angeles, Calif.

[21] Appl. No.: 504,778

[22] Filed: Jun. 16, 1983

[51] Int. Cl.[4] ..... B29C 1/02

[52] U.S. Cl. ..... 264/221; 164/36; 249/61; 249/134; 264/317; 264/DIG. 44

[58] Field of Search ..... 264/221, DIG. 44, 317; 249/61, 134; 164/35, 36, 44, 45, 521

[56] References Cited

U.S. PATENT DOCUMENTS

| | | | |
|---|---|---|---|
| 1,896,123 | 2/1933 | Schweitzer | 425/DIG. 12 |
| 2,315,394 | 3/1943 | Brosius | 249/61 |
| 2,635,294 | 4/1953 | Rolaston | 264/221 |
| 3,059,282 | 10/1962 | Smith | 264/221 |
| 3,339,622 | 9/1967 | Horton | 264/221 |
| 3,538,213 | 11/1970 | Robert | 264/221 |
| 3,671,007 | 6/1972 | Bailey et al. | 249/134 |
| 4,108,931 | 8/1978 | Ogden | 264/221 |

FOREIGN PATENT DOCUMENTS

| | | | |
|---|---|---|---|
| 754861 | 1/1971 | Belgium | 164/45 |
| 43-6136 | 3/1968 | Japan | 264/221 |
| 43-24162 | 10/1968 | Japan | 164/45 |
| 49-11535 | 3/1974 | Japan | 164/45 |

*Primary Examiner*—James Lowe

*Attorney, Agent, or Firm*—J. Henry Muetterties; A. J. Miller

[57] ABSTRACT

A method and apparatus for casting of fragile complex shapes by the formation of a two layer wax mold about a pattern of the shape to be cast. Thereafter, the pattern is removed from the mold and the outer layer of wax dissolved. The slip is then poured into the mold and allowed to solidify before the inner layer of the mold is completely removed from the cast article.

20 Claims, 4 Drawing Figures

MOLD AND METHOD FOR CASTING OF FRAGILE AND COMPLEX SHAPES

BACKGROUND AND SUMMARY OF THE INVENTION

The present invention relates to the art of making castings and, more particularly, to precision casting of fragile and complex shapes.

In general, castings and especially metallic castings are easily removed from the mold if the casting is of a simple shape, i.e., no curved parts or thin walled sections. However, when working with complex shapes such as a bladed rotor, and especially a curved blade airfoil configuratin, removal of the cast shape becomes very difficult and can only be accomplished with very expensive tooling which is not economically feasible in many situations. Presently in the art, wax patterns of the article to be cast are formed by injection molding and thereafter a refractory mass is cast about the patterns. Once the refractory mold is dry the wax is melted leaving a mold with a cavity in the shape of the article to be cast. Once cast, nondestructive mold removal of the low strength cast articles is nearly impossible because of the fragile condition of the cast material.

Accordingly, it is an object of the invention to provide a mold and a process which permits casting of fragile, complex shapes.

It is another object of the invention to provide a process, as described, which is reliable, practicable and economical for production applications.

Briefly, the present imvention discloses a mold and method for making low strength castings through the use of a flexible rubber pattern in the shape of the article to be cast and a two layer wax mold. The rubber pattern is secured to a base plate called a "drag" having a threaded center hole. The mounted pattern is then dipped into a first molten wax to coat the pattern with a first layer of wax. Thereafter, the hardened unit is dipped into a second wax bath of a water soluble wax in order to form a second layer of wax, which together with the first layer, forms a monolithic mold. When the second layer of wax has sufficiently hardened, the pattern is extracted from the two layer wax mold utilizing a puller assembly, which leaves an impression in the mold in the shape of the article to be cast. The mold assembly is then submerged in a water bath to dissolve the water soluble outer layer of the mold assembly. Once dried, the mold is placed on a plaster base and a slip poured into the impression and allowed to solidify. Thereafter, the inner layer of the wax mold is removed from the plaster base by submersion of the mold into an organic solvent which chemically dissolves the first layer of wax, leaving the cast article intact.

DETAILED DESCRIPTION OF THE INVENTION

Figure 1:
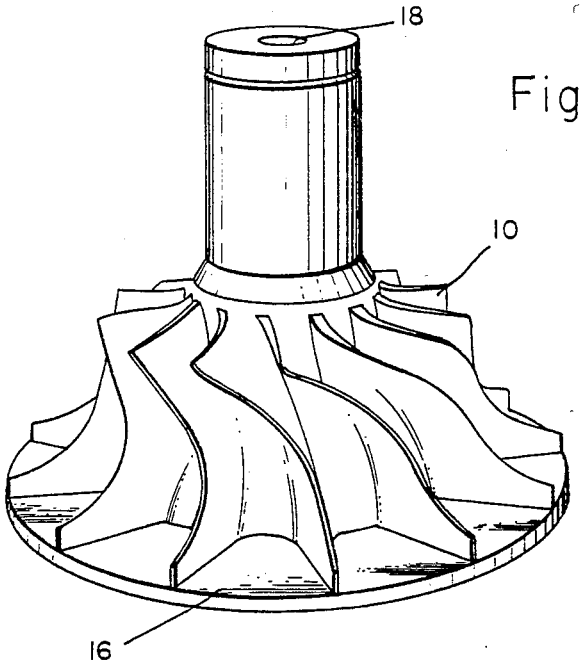
FIG. 1 is a full perspective view of the drag mounted pattern.
Figure 2:
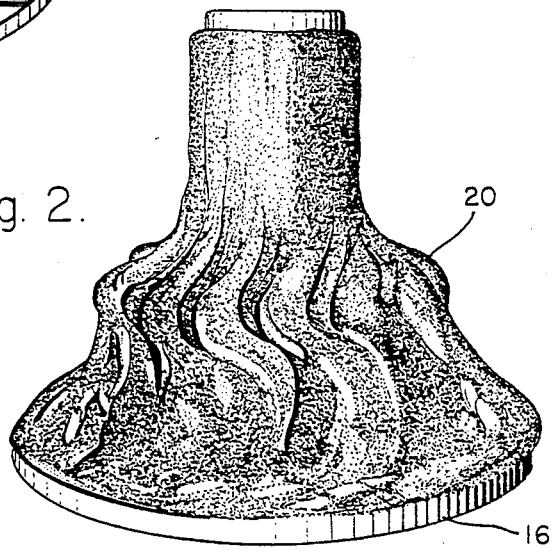
FIG. 2 is a full perspective view of the pattern covered with a first layer of wax.

Referring to the drawings and to FIG. 1 in particular, there is shown a typical pattern 10 that is in the shape of the article to be cast using the teachings of the present invention. Pattern 10 is, for example, the pattern for a compressor or turbine wheels of a turbocharger which are to operate at very high speeds and temperatures. The pattern 10 has a base portion forming the hub of the compressor wheel and a plurality of blades protruding therefrom. Pattern 10 may have any form or shape provided, however this shape is shown to illustrate that this inventive concept is especially suited to work well with fragile and/or complex shapes. In this particular case, "fragile and complex" refers to shapes having thin walls and/or overlapping sections which make nondestructive mold removal impossible. A drag or base plate 16, preferably metallic, having a threaded center hole 18 is secured to the pattern 10. The reuseable pattern 10 is normally made of a room temperature vulcanized rubber and is thoroughly cleaned to remove any trace of surface contaminants that might prevent adhesion of a wax to the rubber. Pattern 10 is then dipped into a first molten mold wax bath of a first wax to form an inner or first layer 20 about the pattern. Generally, the pattern 10 is repeatedly dipped into the first molten mold bath until a layer or coating having a thickness of approximately 0.035 to 0.045 inches is obtained as shown in FIG. 2. A suitable wax to be used as the first mold wax is any polyethylene glycol based wax which is insoluble in water. Polyethylene glycol based waxes also retain their definition and provide good surface finishes.

Figure 3:
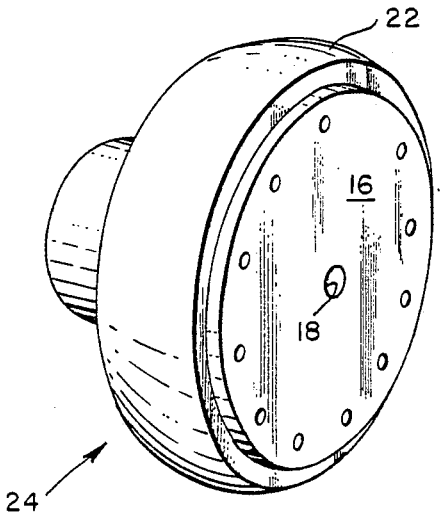
FIG. 3 is a full perspective view of the pattern covered with both the first and second layer of waxes.

Once the inner or first layer 20 of mold wax has hardened, the wax covered pattern is dipped into a second molten wax bath of a second wax. The wax covered pattern is repeatedly submersed into the second wax bath until a second or outer layer 22 of wax, 0.25 to 0.5 inches thick, is obtained as shown in FIG. 3. It is necessary that this second wax be water soluble and has a melting temperature less than the melting temperature of the first wax, otherwise, submersion of the wax covered pattern into the second molten wax bath could melt the first layer 20 of the first wax off the pattern 10. Paraffin based waxes have been found to be suitable for use as the second wax in that they are water soluble and have lower melting temperature than polyethylene glycol based waxes. Alternatively, the second layer 22 of the second wax can be applied to the first layer 20 by enclosing the wax coated pattern in a rubber cope (not shown). The water soluble second wax is melted and poured into the cope and allowed to harden. This alternative method gives greater support to the mold during removal of the pattern from the mold.

The application of the second layer of wax 20 to the to the first layer 22 of wax forms a monolithic mold 24. It is the purpose of this outer layer 22 to serve as a support to prevent distortion or breakage of the mold 24 during the stripping operation, since the final shape of the cast article depends on the accuracy of the impression or cavity left in the first layer 20 of the mold 24 after pattern removal.

Figure 4:
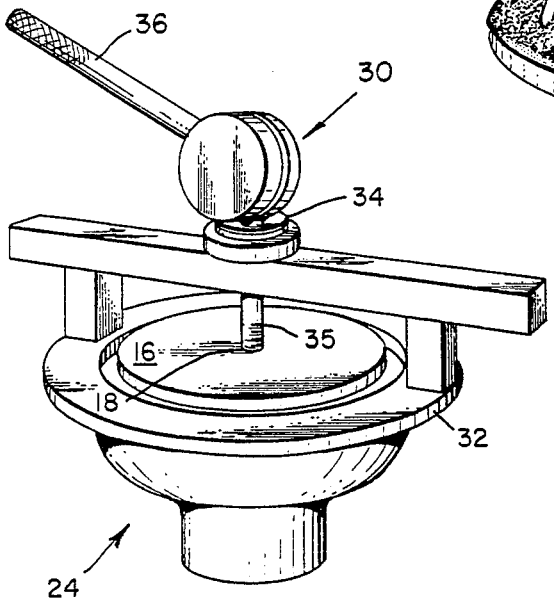
FIG. 4 is a full perspective view of a puller assembly used to remove the pattern from the mold.

As shown in FIG. 4, removal of the pattern 10 from the mold 24 is accomplished using a puller assembly 30 comprising a mold retaining section 32 and puller section 34. The puller section 34 has a threaded bolt 35 and a handle member 36. The mold retaining section 32 circumscribes the drag plate 16 and exerts a force on the mold 24 in the opposite direction of the force exerted by the puller section 34 on the pattern 10. The threaded bolt 35 is connected to the handle member 36 at one end thereof. The other end is threaded into the drag 16 to which the pattern 10 is attached. When the handle member 36 is rotated, the bolt transmits an upward axial force to the drag 16, which in turn eases the pattern 10 from the monolithic mold 24.

Once the pattern has been extracted from the two layer wax mold 24, the mold is submersed into a water bath to dissolve the outer layer 22 of mold 24. The air dried mold, which now consists of only the inner layer 20 of the first wax, is inspected for defects. It is important that the impression left by the pattern be examined for irregularities since the amount of tooling required to produce a viable cast article depends on the quality of the mold. The mold is thin enough to be transparent yet strong enough not to deform during the pouring operation. Once examined, the mold is positioned on a plaster base and a slip poured into the cavity. The slip is a slurry of water and the dry constituents of the material to be cast. The composition of the slip varies depending upon the final use of the cast article and properties desired. In this case a ceramic, silicon nitride is used, though powdered metals work equally well with this invention. The use of a plaster base is advantageous in that it absorbs the water of the slip and therefore aids in the drying process. During the pouring of the slip, the operator inspects the mold to determine if any air bubbles have been trapped within the mold. If bubbles do appear the mold can be vented to the atmosphere by piercing a small hole in the mold. After the slip has sufficiently solidified, the inner wax layer 20 is removed by dipping the mold into an organic solvent such as trichlorethylene which chemically dissolves the inner wax layer. The cast article is free of any trace of the mold wax and can thereafter be subjected to any heat treatment and machining necessary to produce a viable product.

While the invention has been illustrated with a turbine wheel having a curved blade airfoil configuration it is equally useful in arrangements with other complex shapes. Also, other mold wax material can be used in conjunction with this casting technique and mold. These and other modifications and steps will be apparent to those skilled in the art. Accordingly, the foregoing detailed description of the preferred embodiment and process of the invention are considered to be exemplary in nature and not as limiting to the scope and spirit of the invention as set forth in the appended claims.

Having thus described the invention with sufficient clarity that those skilled in the art may make and use it, what is claimed and desired to be secured by Letters Patent is:

1. A method of casting articles comprising the steps of:

providing a pattern of the shape to be cast;

forming a mold about the pattern having an inner and an outer layer of a first and a second wax, said first wax having a melting temperature greater than said second wax;

extracting the pattern from the mold, thereby forming an impression of the pattern in the inner layer of the mold;

removing the outer layer of wax;

pouring a slip into the impression in the mold;

allowing the slip to solidify while in the mold; and removing the inner layer of wax.

2. The method according to claim 1 wherein the step of forming a mold about the pattern comprises the step of:

coating the pattern with an inner layer of a water insoluble first wax and an outer layer of a water soluble second wax.

3. The method according to claim 2 wherein the step of removing the outer layer of wax comprises the step of dipping the mold into water.

4. The method according to claim 3 wherein the step of removing the inner layer of wax comprises the step of dipping the mold into an organic solvent.

5. A method of casting articles comprising the steps of:

providing a pattern of the article to be cast;

forming a mold about the pattern having a first wax layer and a second, water soluble wax layer, said first wax having a melting temperature greater than said second wax;

extracting the pattern from the mold thereby forming an impression of the pattern in the first wax layer of the mold;

submersing the mold into a water bath to remove the second wax layer;

pouring a slip into the impression in the remaining first wax layer;

allowing the slip to solidify while in the first wax layer; and removing the first layer of wax.

6. A method of casting articles according to claim 5 wherein the step of forming a mold about the pattern further comprises:

coating the pattern with a first layer of water insoluble wax and a second layer of water soluble wax.

7. A method of casting fragile and complex shaped articles comprising the steps of:

securing a base plate to a room temperature vulcanized rubber pattern of the article to be cast having a threaded center hole;

dipping the pattern into a molten wax to coat the pattern with a first layer of wax;

enclosing the wax coated pattern with a flexible cope;

pouring a molten, water soluble second wax having a melting temperature less than the first layer of wax into the cope, thereby forming a second layer of wax, said first and second layers of wax forming a two layer wax mold;

extracting the pattern from the two layer wax mold utilizing the center threaded base plate;

submersing the mold in a water bath to dissolve the second layer of wax thereby leaving a one layer mold;

placing the one layer mold on a plaster base;

pouring a slip into the one layer and allowing the slip to solidify;

chemically dissolving the first layer of wax in an organic solvent, thereby leaving the cast article intact.

8. The method of claim 7 wherein the first layer of wax is polyetheylene glycol based.

9. The method of claim 7 wherein the organic solvent is trichlorethylene.

10. The method of claim 7 wherein the second wax is paraffin based.

11. The method of claim 7 wherein the thickness of the first layer of wax is approximately 0.035 to 0.045 inches.

12. The method of claim 7 wherein the thickness of the second layer of wax is approximately 0.25 to 0.5 inches.

13. A method of casting fragile and complex shapes comprising the steps of:

providing a pattern of the article to be cast;

dipping the pattern into a first molten wax to form a first layer of wax about the pattern;

dipping the pattern into a second, water soluble molten wax having a melting temperature less than said first molten wax to form a second layer of wax about the first layer of wax, thereby creating a mold;

extracting the pattern from the mold thereby forming an impression of the pattern in the mold;

dissolving the second layer in water;

pouring a slip into the impression;

allowing the slip to solidify; and dissolving the first wax layer in an organic solvent.

14. The method of claim 13 wherein the step of dipping the pattern into a second molten wax is repeated as necessary to form a second wax thickness of approximately 0.25 to 0.5 inches.

15. The method of claim 13 wherein the first molten wax is polyetheylene glycol based.

16. The method according to claim 15 wherein the step of chemically dissolving the first layer of wax comprises the step of submersing the mold into a liquid bath of trichlorethylene.

17. The method according to claim 16 wherein the second water soluble molten wax is paraffin based.

18. A method of casting fragile and complex shaped articles comprising the steps of:

securing a base plate to a vulcanized rubber pattern of the article to be cast;

coating the vulcanized rubber pattern with a first layer of wax;

enclosing the wax coated pattern with a flexible cope;

pouring a molten, water soluble second wax having a melting temperature less than the first layer of wax into the cope, thereby forming a second layer of wax, said first and second layers of wax forming a two layer wax mold;

extracting the pattern from the two layer wax mold;

removing the second layer of wax thereby leaving a one layer mold;

placing the one layer mold on a plaster base;

pouring a slip into the one layer mold and allowing the slip to solidify;

removing the first layer of wax, thereby leaving the cast article intact.

19. The method according to claim 18 further including the step of forming a threaded center hole in the base plate.

20. A mold used to produce fragile/complex shapes comprising:

an inner layer of a polyethelene glycol based wax which defines the shape of the article to be made and an outer layer of a paraffin based wax, the melting temperature of the inner layer of wax being greater than the melting temperature of the outer layer of wax.

* * * * *